US006800596B1

(12) United States Patent
Loper

(10) Patent No.: US 6,800,596 B1
(45) Date of Patent: Oct. 5, 2004

(54) LUBRICATING OIL DISPERSANT

(75) Inventor: John T. Loper, Richmond, VA (US)

(73) Assignee: Afton Chemical Intangibles, LLC, Richmond, VA (US)

( * ) Notice: Subject to any disclaimer, the term of this patent is extended or adjusted under 35 U.S.C. 154(b) by 0 days.

(21) Appl. No.: 10/434,594

(22) Filed: May 9, 2003

(51) Int. Cl.[7] ..... C10M 159/16
(52) U.S. Cl. ..... 508/192; 508/221; 508/242; 508/292; 508/542
(58) Field of Search ..... 508/192, 232, 508/229, 542

(56) References Cited

U.S. PATENT DOCUMENTS 4,248,725 A * 2/1981 Crawford et al. ..... 508/229
4,636,322 A 1/1987 Nalesnik
4,699,724 A 10/1987 Nalesnik et al.
4,713,189 A 12/1987 Nalesnik et al.
5,872,083 A * 2/1999 Harrison et al. ..... 508/287
6,107,450 A * 8/2000 Harrison et al. ..... 528/329.1
6,176,886 B1 1/2001 Loper et al.
6,358,892 B1 * 3/2002 Harrison et al. ..... 508/192
6,548,458 B2 4/2003 Loper

* cited by examiner

*Primary Examiner*—Ellen M McAvoy
(74) *Attorney, Agent, or Firm*—Dennis H. Rainear; Leah Oubre Robinson

(57) ABSTRACT

An improved dispersant is prepared by cross-linking a succinimide under Mannich reaction conditions with a polyphenolic compound. The amount of cross-linking, and the resulting size of the reaction product dispersant can be varied by varying the molecular equivalent ratios of succinimide and polyphenol. Lubricating oils containing the dispersant of the reaction product display superior performance.

49 Claims, No Drawings

LUBRICATING OIL DISPERSANT

LUBRICATING OIL DISPERSANT

This invention is related to lubricating oils, lubricating oil additives, and more particularly to a dispersant composition in the oil or additive, the dispersant formed from the Mannich reaction of a polyphenolic compound with a succinimide. The compositions of the present invention may further be posted-treated to form derivatized dispersants.

BACKGROUND OF THE INVENTION

Internal combustion engines operate under a wide range of temperatures including low temperature stop-and-go service as well as high temperature conditions produced by continuous high speed driving. Stop-and-go driving, particularly during cold, damp weather conditions, leads to the formation of sludge in the crankcase and in the oil passages of a gasoline or a diesel engine. This sludge seriously limits the ability of the crankcase oil to effectively lubricate the engine. In addition, the sludge with its entrapped water tends to contribute to rust formation in the engine. These problems tend to be aggravated by the manufacturer's lubrication service recommendations, which specify extended oil drain intervals.

It is known to employ nitrogen containing dispersants and/or detergents in the formulation of crankcase lubricating oil compositions. Many of the known dispersant/detergent compounds are based on the reaction of an alkenylsuccinic acid or anhydride with an amine or polyamine to produce an alkylsuccinimide or an alkenylsuccinic acid as determined by selected conditions of reaction.

Also it is known to chlorinate alkenylsuccinic acid or anhydride prior to the reaction with an amine or polyamine in order to produce a reaction product in which a portion of the amine or polyamine is attached directly to the alkenyl radical of the alkenyl succinic acid or anhydride. The thrust of many of these processes is to produce a product having a relatively high level of nitrogen in order to provide improved dispersancy in a crankcase lubricating oil composition.

With the introduction of four cylinder internal combustion engines which must operate at relatively higher engine speeds or RPM's than conventional 6-and 8-cylinder engines in order to produce the required torque, it has become increasingly difficult to provide a satisfactory dispersant anti-oxidant lubricating oil composition.

Recessive valve train wear, piston deposits, and oil thickening can occur at high engine operating temperatures with poorly formulated lubricating oils. Valve train wear and piston deposits can cause engine malfunction and in some cases result in engine failure. Excessive oxidative oil thickening can prevent the oil from flowing to the engine's oil pump causing the engine to seize due to lack of lubrication.

The conventional sludge dispersants for lubricating oils have been of the polyisobutenyl succinimide type for over 20 years. Recent changes in test procedures have made it more difficult to qualify these types of dispersants for use in lubricating oils without substantially increasing their treating dosage.

DETAILED DESCRIPTION OF EMBODIMENTS OF THE INVENTION

Embodiments of the present invention are directed to a dispersant composition and a method of preparing a dispersant composition. This dispersant is included in a lubricating oil or as an additive for a lubricating oil. The lubricant dispersant has a high molecular weight. It is prepared by cross-linking a conventional succinimide (for example a bis-alkenyl succinimide) under Mannich reaction conditions with a polyphenolic compound. The resulting cross-linked dispersant, having more than one aromatic moiety, is a dispersant composition with an increased ability to suspend sludge and soot. The amount of cross-linking, and the resulting size of the reaction product dispersant can be varied by changing the molecular equivalent ratios of succinimide and polyphenol in the reaction steps.

The succinimide is the reaction product of a long chain hydrocarbyl-substituted succinic acylating agent and a polymine. The long chain hydrocarbon group is for example ($C_2$–$C_{10}$) polymer, e.g., a ($C_2$–$C_5$) monoolefin, the polymer having a number average molecular weight (Mn) of about 500 to about 10,000. Exemplary olefin polymers for reaction with the unsaturated dicarboxylic acid anhydride or ester are polymers comprising a major molar amount of ($C_2$–$C_{10}$) polymer, e.g., a ($C_2$–$C_5$) monoolefin. Such olefins include ethylene, propylene, butylene, isobutylene, pentene, 1-octene, styrene, etc. The polymers can be homopolymers such as polyiosbutylene, as well as copolymers of two or more of such olefins such as copolymers of: ethylene and propylene, butylene and isobutylene, propylene and isobutylene, etc. Other copolymers include those in which a minor molar amount of the copolymers e.g., 1 to 10 mole % is a ($C_4$–$C_{10}$) non-conjugated diolefin, e.g., a copolymer of isobutylene and butadiene; or a copolymer of ethylene, propylene and 1,4-hexadiene; etc. The bis-alkenyl succinimide, in one example, has a succinic anhydride to polyisobutylene ratio ranging from 0.9 to 4.0, and has an anhydride to amine ratio ranging from 1:1 to 3:1.

In some cases, the olefin polymer may be completely saturated, for example an ethylene-propylene copolymer made by a Ziegler-Natta synthesis using hydrogen as a moderator to control molecular weight. In one example, the alpha- and beta-unsaturated dicarboxylic acid anhydride is reacted with the saturated ethylene-propylene copolymer utilizing a radical initiator.

The long chain hydrocarbyl-substituted succinic acylating agent, e.g. acid or anhydride, includes a long chain hydrocarbon, generally a polyolefin, substituted typically with an average of at least about 0.8 per mole of polyolefin, of an alpha- or beta-unsaturated ($C_4$–$C_{10}$) dicarboxylic acid, anhydride or ester thereof, such as fumaric acid, itaconic acid, maleic acid, maleic anhydride, chloromaleic acid, dimethylfumarte, chloromaleic anhydride, acrylic acid methacrylic acid, crotonic acid, cinnamic acid, and mixtures thereof.

An alkenyl succinic acid anhydride may be characterized by the following formula:

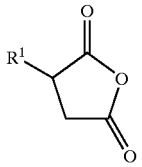

In the above formula, $R^1$ may be residue (containing residual unsaturation) from a polyolefin, which was reacted with maleic acid anhydride to form the alkenyl succinic acid anhydride. $R^1$ may have a number average molecular weight (Mn) ranging from about 500–10,000, for example about 1000–5000, and for another example from about 2000–2500.

The polyamine compositions which may be employed may include primary and/or secondary amines. The amines may typically be characterized by the formula:

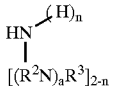

In this formula, "a" may be an integer of about 3 to about 8, for example about 5; and may be 0 or 1. In the above compound, $R^2$ may be hydrogen or a hydrocarbon group selected from the group consisting of alkyl, aralkyl, cycloalkyl, aryl, alkaryl, alkenyl, and alkynyl, including such radicals when inertly substituted. Exemplary $R^3$ groups may be hydrogen or lower alkyl group, i.e. $C_1$–$C_{10}$ alkyl, groups including, e.g., methyl, ethyl, n-propyl, i-propyl, butyls, amyls, hexyls, octyls, decyls, etc. $R^3$ may be hydrogen. $R^2$ may be a hydrocarbon selected from the same group as $R^3$ subject to the fact that $R^2$ is divalent and contains one less hydrogen. In one example, $R^3$ is hydrogen and $R^2$ is —$CH_2CH_2$—. The preferred amines are polyamines and hydroxyamines. Examples, of polyanines that may be used include, but are not limited to, aminoguanidine bicarbonate (AGBC), diethylene triamine (DETA), triethlene tetramine (TETA), tetraethylene pentamine (TEPA), pentaethylene hexamine (PEHA) and heavy polyamines. A heavy polyamine is a mixture of polyalkylenepolyamines comprising small amounts of lower polyamine oligomers such as TEPA and PEHA but primarily oligomers with 7 or more nitrogens, 2 or more primary amines per molecule, and more extensive branching than conventional polyamine mixtures. Other examples of succinimide reaction polyamines and other reagents are set forth in U.S. Pat. No. 6,548,458 B2, incorporated by reference herein in its entirety.

Representative aldehydes for use in the Mannich reaction of the present invention include the aliphatic aldehydes such as formaldehyde, acetaldehyde, propionaldehyde, butyraldehyde, valeraldehyde, caproaldehyde, heptaldehyde, stearaldehyde. Aromatic aldehydes that may be used include benzaldehyde and salicylaldehyde. Illustrative heterocyclic aldehydes for use herein are furfural and thiophene aldehyde, etc. Also useful as aldehydes in the present invention are formaldehyde-producing reagents such as paraformaldehyde, or aqueous formaldehyde solutions such as formalin. In an example, the aldehyde is formaldehyde or formalin.

A "polyphenolic compound" is one having a plurality of aromatic moeties therein. An example of a polyphenolic compound is Bis Phenol A, a condensation product of acetone and phenol. Other polyphenolic compounds include but are not limited to 2,2' biphenol, 4,4' biphenol, 1,6 dihyroxynaphthalene, 2,6 dihyroxynaphthalene, 2,7 dihyroxynaphthalene and a low molecular weight resole (C12 alkyl phenol formaldehyde resin) as taught in U.S. Pat. No. 6,176,886, incorporated herein by reference.

The ratio of polyphenolic compound, for instance, Bis Phenol A, to succinimide range is from 10:1 to 1:5. The ratio may be is from 1:1 to 1:3. The ratio of polyphenolic compound, for example Bis Phenol A, to formaldehyde ranges from 1:5 to 1:1. The ratio may be from 1:3 to 1:2. By varying these ratios, the amount of cross-linked reaction product can be controlled.

One method of actually performing a reaction includes the following steps. The formation of a succinimide has already been discussed earlier herein. The succinimide, for purpose of this example a bis-alkenyl succinimide, and process oil are combined and heated to between 70 and 170° C. under nitrogen. Bis Phenol A (a polyphenol) is added and stirred. The formaldehyde solution (containing a molecular equivalent excess of aldehyde) is added and the reaction mixture is heated at between 100–170° C. for between 2–6h. The reaction product is then cooled and filtered.

The lubricating oil, or an additive to a lubricating oil, will contain the novel reaction product described above in a concentration ranging from about 0.1 to 30 weight percent. A concentration range for an additive ranging from about 0.5 to 15 weight percent based on the total weight of the oil composition is one example with another example concentration range being from about 1 to 8.0 weight percent.

Oil concentrates of the additives may contain from about 1 to 75 weight percent of the additive reaction product in a carrier or diluent oil of lubricating oil viscosity.

The reaction product may be employed in lubricant compositions together with conventional lubricant additives. Such additives may include additional dispersants, detergents, antioxidants, pour point depressants, anti-wear agents and the like.

EXAMPLES

The succinimide-Mannich reaction products set forth in Table I were prepared as follows: Polyphenol, aldehyde and succinimide were combined in a suitable reaction vessel and heated to between 100 and 170° C. under nitrogen. The reaction generally required between 2 and 6 h. The molar ratio of succinimide to polyphenol compound used in preparing the succinimide-Mannich arrays is set forth in the tables. A representative example of a suitable preparation method for the succinimide-Mannich array is as follows (the sample number references are consistent throughout, as the same sample may be subjected to multiple tests):

Example: Preparation of Succinimide-Mannich Array-Sample 7

A 3L resin kettle equipped with overhead stirrer, Dean stark trap, and thermocouple was charged with 1702.6 g of commercial succinimide dispersant Sample #1 (HiTec® 1932) and heated to 160° C. Bis Phenol A, 35 g and 24.9 g of formalin solution were added. The reaction mixture was stirred at 160° C. under a continual nitrogen purge for 3 h. Residual water was removed in vacuo and 53.4 g process oil was added to afford 1754.3 g of product.

Example A

Reaction product kinematic viscosity at 100° C. and GPC analysis can be used to indicate the preparation of a higher molecular weight, cross-linked compound in accordance with the present invention. Table I contains the kinematic viscosity and the GPC analysis for some compounds prepared in accordance with the present invention. The increase in product viscosity and the evidence of higher molecular weight and polydispersity from the GPC indicates that high molecular weight cross-linked compounds have been synthesized. See FIGS. I and II for an idealized reaction scheme.

TABLE I

Succinimide-Mannich Arrays
Physical and Chemical Properties

| Sample | Dispersant | KV @ 100 (cSt) | GPC Mn | Results Polydispersity |
|---|---|---|---|---|
| 1 | Base (succinimide/no bis-phenol A) | 200 | 6578 | 2.11 |
| 2 | Succinimide-BPA (2.5:1) | 292 | | |
| 3 | Succinimide-BPA (2.5:1) | 274 | 7446 | 2.64 |
| 4 | Succinimide-BPA (2.0:1) | 367 | 7985 | 2.79 |
| 5 | Succinimide-BPA (2.0:1) | 375 | | |
| 6 | Succinimide-BPA (1.75:1) | 428 | 8447 | 3.13 |
| 7 | Succinimide-BPA (1.5:1) | 540 | 8804 | 3.53 |
| 8 | Succinimide-BPA (1.5:1) | 518 | | |

TABLE I-continued

Succinimide-Mannich Arrays
Physical and Chemical Properties

| Sample | Dispersant | KV @ 100 (cSt) | GPC Mn | Results Polydispersity |
|---|---|---|---|---|
| 9 | Succinimide-BPA (1.3:1) | 682 | 9394 | 3.99 |
| 10 | Succinimide-BPA (1.3:1) | 706 | | |

A series of compounds have been synthesized as comparative examples, which utilized an alkyl phenol (nonyl phenol) in the Mannich reaction step. The physical and chemical properties are in Table II.

TABLE II

Comparative Examples
Physical and Chemical Properties

| Sample | Dispersant Code | KV @ 100C (cSt) | GPC Mn | Results Polydispersity |
|---|---|---|---|---|
| 1 | Succinimide | 200 | 6578 | 2.11 |
| 11 | Succinimide-NP (2.5:1) | 207 | 6347 | 1.98 |
| 12 | Succinimide-NP (2.0:1) | 208 | 6990 | 2.10 |
| 13 | Succinimide-NP (1.5:1) | 215 | 7093 | 2.15 |

Note that in the comparative examples with the alkyl phenol, the product KV and Mn are not much different from the starting material. This suggests that there is very little cross-linking of succinimide strands in these reaction products. The reaction products using polyphenols in Table I, on the other hand, exhibit the physical properties of the cross-linked compounds shown in FIGS. I and II.

Figure I
Succinimide-BPA (2.0:1)

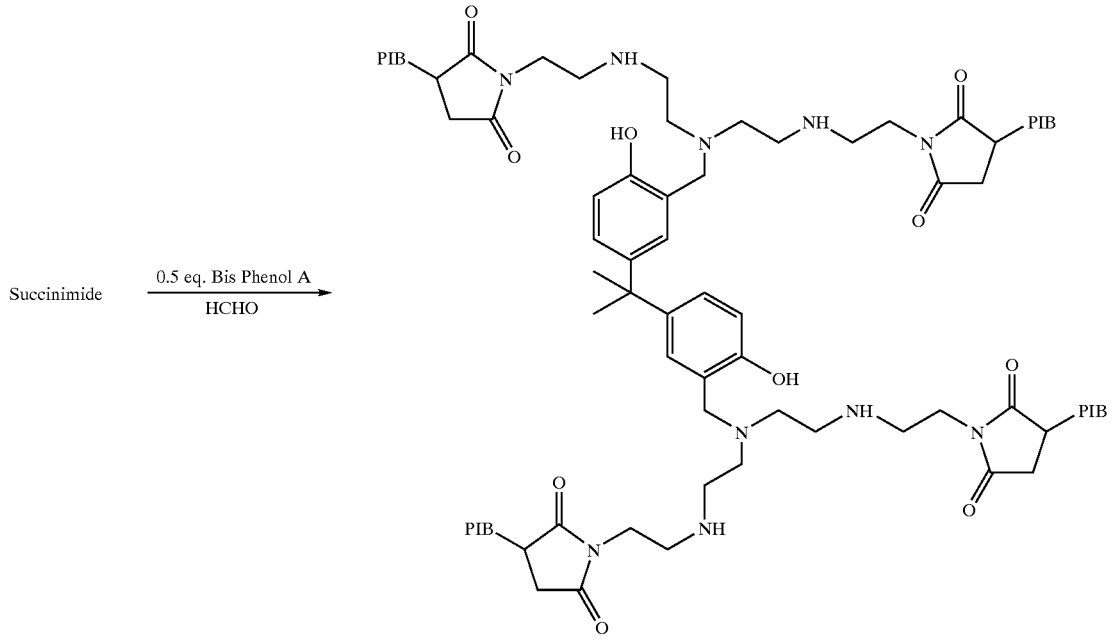

Figure II
Succinimide-Mannich Array

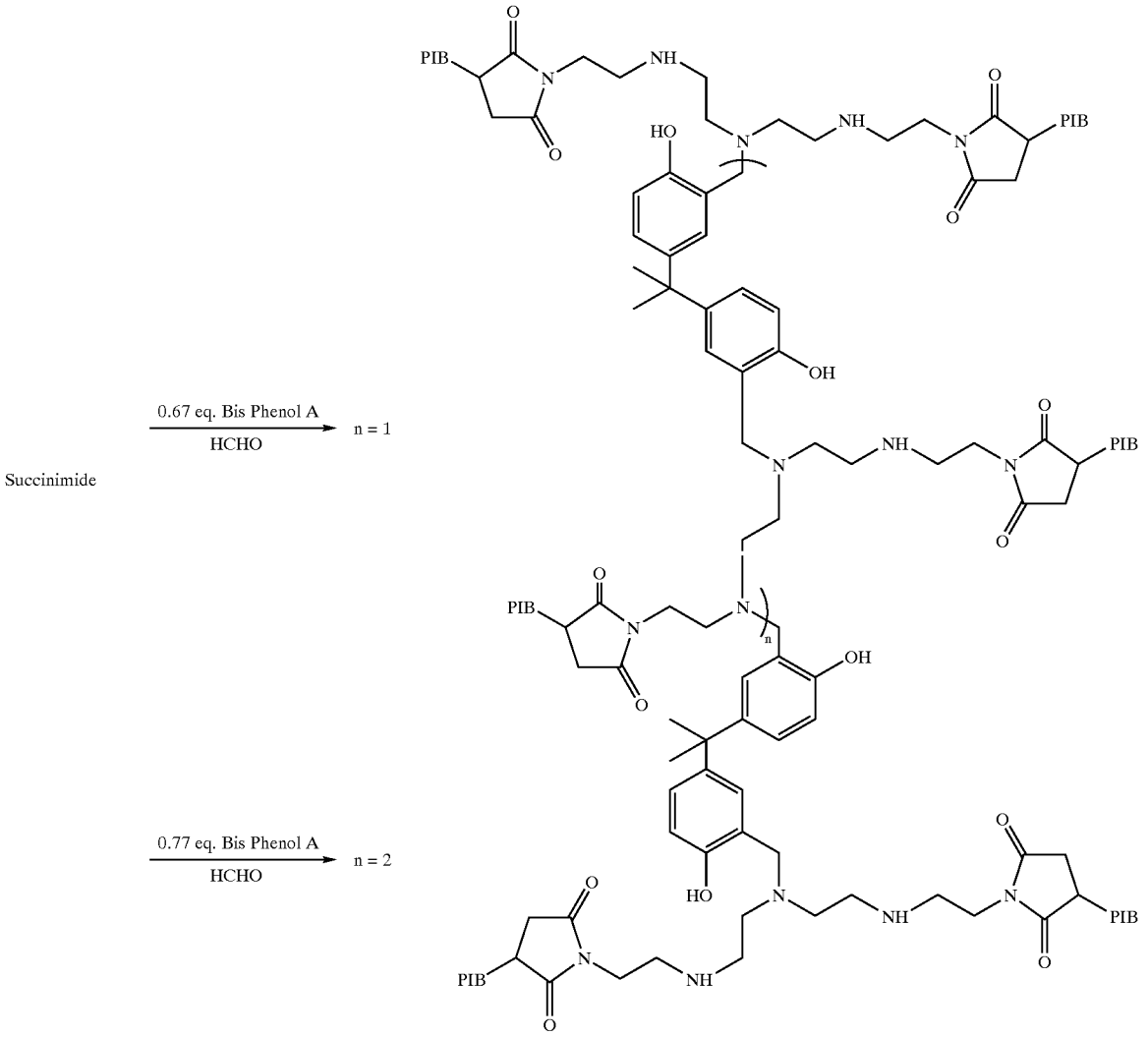

Example B

Performance Testing

Passenger Car Motor Oil (PCMO)

Additives made in accordance with the processes herein, and Commercial 1 and Commercial 2 were blended into a motor oil formulation utilizing metal-containing sulfonates, zinc dithiophosphate wear inhibitors, sulfur containing antioxidants, diaryl amine and phenolic antioxidants, oleate and molybdenum friction modifiers, a pour point depressant, and a viscosity index improver (HiTEC® 5815).

The sample additives and the commercial dispersants 1 and 2 were of nearly equal activities (around 40 wt.%). The sample dispersants impart significant 100% C. viscosity lift to finished oils with no adverse effects on low temperature viscometrics. These blends easily meet the 5W–30 low temperature −30° C. cold crank simulator specification.

Examples of lubricating oils containing reaction products described herein exhibited a blend KV increase ranging from 2.4 to 5.3% increase with essentially no effect on cold crank starts at −30° performance when compared to a control formulation.

TABLE III

Succinimide-Mannich Dispersants
Blend Viscometric Data

| Sample | Dispersant Code | 100C Viscosity (cSt) | Cold Crank (cP) |
|---|---|---|---|
| 1 | Commerical Succinimide #1 | 10.80 | 6510 |
| 3 | Succinimide-BPA (2.5:1) | 10.90 | 6208 |
| 4 | Succinimide-BPA (2.0:1) | 10.95 | 6277 |
| 6 | Succinimide-BPA (1.75:1) | 11.03 | 6235 |
| 7 | Succinimide-BPA (1.5:1) | 11.20 | 6217 |
| 11 | Succinimide-NP (2.5:1) | 10.71 | 6517 |
| 12 | Succinimide-NP (2:1) | 10.67 | 6392 |
| 13 | Succinimide-NP (1.5:1) | 10.66 | 6507 |
| 14 | Commerical Succinimide #2 | 10.65 | 6153 |

Note that in the comparative examples with the alkyl phenol, the blend kinematic viscosity (cSt) and cold crank performance (cP) are not much different from the reference blends which contained Commercial #1 and #2 dispersants. This suggests that there is very little cross-linking of succinimide strands in these reaction products.

Ball Rust Test

Examples of lubricating oils containing reaction products of the present invention exhibited similar area gray values as a control formulation.

TABLE IV

Ball Rust Test Data

| Sample | Dispersant Code | BRT Area Gray Value |
|---|---|---|
| 7 | Succinimide-BPA (1.5:1) | 125 |
| 15 | Succinimide-BPA-CA | 113 |
| 14 | Commerical Succinimide #2 | 122 |

Post-treated Variants of the Novel Cross-Linked Dispersants

These novel cross-linked dispersants as described herein can be utilized as is or post-treated with various compounds such as but not limited to mineral acids, carbon based acids, esters, diacids and diesters, anhydrides, Michael acceptors, and mono and poly epoxides. In theory, these active nitrogen containing dispersants are post-treated to cap some of the active nitrogens. Otherwise, the active nitrogen can attack engine seals and gaskets. The post-treatments described herein are steps taken after the cross-linking steps. If the reaction with the active nitrogens occurs before the cross-linking step, then the crosslink may be blocked, or at the very least, much less efficient. The following Tables V and VI demonstrate the comparative post-treated dispersant (Table III) and dispersant that was derivatized before cross-linking (Table IV). The post-treated dispersants display higher molecular weight (Mn).

The post-treated succinimide-Mannich reaction products set forth in Table V were prepared as follows: Succinimide-Mannich reaction product and post-treating agent were combined in a suitable reaction vessel and heated to between 110and 180° C. under nitrogen. The reaction generally required between 2 and 6 h. The molar ratio of succinimide-Mannich reaction product to post-treating reagent used in preparing the post-treated succinimide-Mannich arrays is set forth in the Table III. A representative example of a suitable preparation method for the post-treated succinimide-Mannich array is as follows:

Example: Preparation of Post-treated Succinimide-Mannich Array-Sample 16

A 1L resin kettle equipped with overhead stirrer, Dean stark trap, and thermocouple was charged with 468.2 g of Succinimide-Mannich Array-Sample 7 and heated to 160° C. Citric acid, 2.6 g was added. The reaction mixture was stirred at 160° C. under a continual nitrogen purge for 3 h. Residual water was removed in vacuo and 2.4 g process oil was added to afford 414 g of product.

TABLE V

Post-Treated Succinimide-Mannich Dispersants

| Sample | Dispersant Code | KV @ 100 | Mn | Polydispersity |
|---|---|---|---|---|
| 1 | Commerical Succinimide #1 | 200 | 6161 | 1.97 |
| 3 | Succinimide-BPA (2.5:1) | 274 | 7446 | 2.65 |
| 16 | Succinimide-BPA (1.5:1)-CA (1.5:1) | 726 | 8337 | 3.48 |
| 17 | Succinimide-BPA (1.5:1)-MA (1.5:1) | 883 | 8450 | 3.31 |
| 18 | Succinimide-BPA (1.5:1)-CA (1:1) | 912 | 8121 | 3.65 |
| 19 | Succinimide-BPA (1.5:1)-MA (1:1) | 893 | 8417 | 3.34 |
| 20 | Succinimide-BPA-(1.3:1) CA (1.5:1) | 1113 | 10316 | 4.25 |
| 21 | Succinimide-BPA-(1.3:1) MA (1.5:1) | 1071 | 10519 | 3.97 |
| 22 | Succinimide-BPA-(1.3:1) CA (1:1) | 1390 | 10492 | 4.56 |
| 23 | Succinimide-BPA-(1.3:1) MA (1:1) | 1311 | 10949 | 4.72 |

TABLE VI

Post-Treated Succinimide Dispersants

| Sample | Dispersant Code | KV @ 100 | Mn | Polydispersity |
|---|---|---|---|---|
| 1 | Commerical Succinimide #1 | 200 | 6161 | 1.97 |
| 24 | Succinimide-CA (2:1) | 374.6 | 6075 | 1.98 |
| 25 | Succinimide-MA (1:0.33) | 302.5 | 6246 | 2.13 |
| 14 | Commerical Succinimide #2 | 330 | 5868 | 1.94 |

Note that in the comparative examples without the Mannich reaction step (Table VI), the product Mn and polydispersity are not much different from the starting material, Commercial dispersant #1. This suggests that there is very little cross-linking of succinimide strands in these reaction products.

Viscosity Index Credit

The additives of this invention also contribute significant viscosity index credit to finished oils, reducing the amount of conventional viscosity index improver required to achieve a desired viscosity target. Reducing the amount of viscosity index improver in a motor oil can thus offer both cost and engine cleanliness advantages. Table VII details viscosity index credit advantages exhibited by several dispersant arrays. These polymeric dispersants additives of the process described herein require lower amounts of the viscosity index improver to meet the 100% C. relative to the Commercial Succinimide dispersants #1 and #2.

TABLE VII

Post-Treated Succinimide-Mannich Dispersants

| Sample | Dispersant Code | 100C Visco | Cold Crank (cP) |
|---|---|---|---|
| 1 | Commerical Succinimide #1 | 10.80 | 6510 |
| 16 | Succinimide-BPA (1.5:1)-CA (1.5:1) | 11.11 | 6221 |
| 17 | Succinimide-BPA (1.5:1)-MA (1.5:1) | 11.07 | |
| 18 | Succinimide-BPA (1.5:1)-CA(1:1) | 11.20 | 6217 |
| 19 | Succinimide-BPA (1.5:1)-MA(1:1) | 11.17 | 6333 |
| 20 | Succinimide-BPA-(1.3:1) CA (1.5:1) | 11.51 | 6144 |
| 21 | Succinimide-BPA-(1.3:1) MA (1.5:1) | 11.41 | 6184 |
| 22 | Succinimide-BPA-(1.3:1) CA (1:1) | 11.48 | 6296 |
| 23 | Succinimide-BPA-(1.3:1) MA (1:1) | 11.40 | 6171 |
| 14 | Commerical Succinimide #2 | 10.70 | 6211 |

Examples of lubricating oils containing reaction products of the present invention exhibited a blend KV increase ranging from 4.3 to 8.1% increase with essentially no effect on cold crank starts at −30° performance when compared to a control formulation.

TABLE VIII

Post-Treated Succinimide Dispersants

| Sample | Dispersant Code | 100C Viscosity (cSt) | Cold Crank (cP) |
|---|---|---|---|
| 1 | Commerical Succinimide #1 | 10.80 | 6510 |
| 24 | Succinimide-CA (2:1) | 10.97 | 6306 |
| 25 | Succinimide-MA (1:0.33) | 10.98 | 6605 |
| 14 | Commerical Succinimide #2 | 10.70 | 6211 |

Note that in the comparative examples without the Mannich reaction step (Table VIII), the blend kinematic viscosity (cSt) and cold crank performance (cP) are not much different from the reference blends which contained Commercial Succinimide Dispersants #1 and #2. This suggests that there is very little cross-linking of succinimide strands in these reaction products.

Figure III
Post-Treated Succinimide-Mannich Dispersants

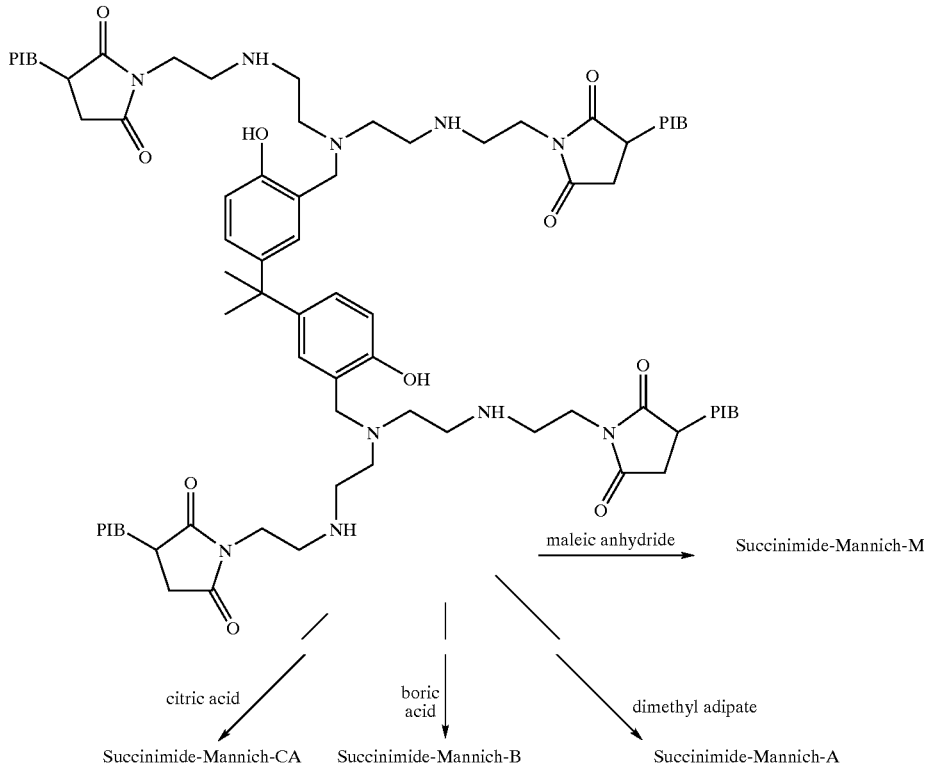

This invention is susceptible to considerable variation in its practice. Therefore the foregoing description is not intended to limit, and should not be construed as limiting, the invention to the particular exemplifications presented hereinabove. Rather, what is intended to be covered is as set forth in the ensuing claims and the equivalents thereof permitted as a matter of law.

Patentee does not intend to dedicate any disclosed embodiments to the public, and to the extent any disclosed modifications or alterations may not literally fall within the scope of the claims, they are considered to be part of the invention under the doctrine of equivalents.

What is claimed is:

1. A lubricating oil composition comprising a major amount of a lubricating oil and a minor dispersant amount of a reaction product prepared by the process which comprises the steps of:

reacting a polyamine with a hydrocarbyl-substituted succinic acylating agent to form a succinimide;

adding an excess of an aldehyde to the succinimide to form an iminium salt of the succinimide;

adding a polyphenolic compound selected from the group consisting of Bis Phenol A; 2,2' biphenol; 4,4' biphenol; 1,6 dihydroxynaphthalene; 2.6 dihydroxynaphthalene; 2,7 dihydroxynaphthalene; and a C12 alkyl phenol formaldehyde resin to the iminium salt to form a Mannich phenol coupled succinimide that exhibits properties attributed to cross-linking.

2. The lubricating oil composition of claim 1, wherein the process steps of adding an aldehyde and adding a polyphenolic compound are a single step.

3. The lubricating oil composition of claim 2, wherein the ratio of molecular equivalents of polyphenolic compound to aldehyde is from about 1:5 to 1:1.

4. The lubricating oil composition of claim 3, wherein the ratio of molecular equivalents of polyphenolic compound to aldehyde is from about 1:3 to 1:2.

5. The lubricating oil composition of claim 1, wherein the ratio of molecular equivalents of polyphenolic compound to succinimide is from about 10:1 to 1:5.

6. The lubricating oil composition of claim 1, wherein the ratio of molecular equivalents of polyphenolic compound to succinimide is from about 1:1 to 1:3.

7. The lubricating oil composition of claim 1, wherein the polyphenolic compound is Bis Phenol A.

8. The lubricating oil composition of claim 1, wherein the aldehyde is formaldehyde.

9. The lubricating oil composition of claim 1, the process further comprising the step of reacting the Mannich phenol coupled succinimide with a mineral acid.

10. The lubricating oil composition of claim 9, wherein the mineral acid is boric acid.

11. The lubricating oil composition of claim 1, the process further comprising the step of reacting the Mannich phenol coupled succinimide with a carboxylic acid.

12. The lubricating oil composition of claim 11, wherein the carboxylic acid is citric acid.

13. The lubricating oil composition of claim 1, the process further comprising the step of reacting the Mannich phenol coupled succinimide with at least one reactant selected from the group consisting of diacids and diesters.

14. The lubricating oil composition of claim 13, wherein the diester is dimethyl adipate.

15. The lubricating oil composition of claim 1, the process further comprising the step of reacting the Mannich phenol coupled succinimide with an anhydride.

16. The lubricating oil composition of claim 15, wherein the anhydride is maleic anhydride.

17. An additive for a lubricating oil composition, the additive comprising a dispersant amount of a reaction product prepared by the process which comprises the steps of:

reacting a polyamine with a hydrocarbyl-substituted succinic acylating agent to form a succinimide;

adding an excess of an aldehyde to the succinimide to form an iminium salt of the succinimide:

adding a polyphenolic compound selected from the group consisting of Bis Phenol A, 2,2' biphenol: 4,4' biphenol; 1,6 dihydroxynaphthalene; 2,6 dihydroxynaphthalene; 2,7 dihydroxynaphthalene, and a C12 alkyl phenol formaldehyde resin to the iminium salt to form a Mannich phenol coupled succinimide that exhibits properties attributed to cross-linking.

18. An additive for a lubricating oil composition as claimed in claim 17, wherein the process steps of adding an aldehyde and adding a polyphenolic compound are a single step.

19. An additive for a lubricating oil composition as described in claim 18, wherein the ratio of molecular equivalents of polyphenolic compound to aldehyde is from about 1:5 to 1:1.

20. An additive for a lubricating oil composition as described in claim 19, wherein the ratio of molecular equivalents of polyphenolic compound to aldehyde is from about 1:3 to 1:2.

21. An additive for a lubricating oil composition as described in claim 17, wherein the ratio of molecular equivalents of polyphenolic compound to succinimide is from about 10:1 to 1:5.

22. An additive for a lubricating oil composition as described in claim 17, wherein the ratio of molecular equivalents of polyphenolic compound to succinimide is from about 1:1 to 1:3.

23. An additive for a lubricating oil composition as described in claim 17, wherein the polyphenolic compound is Bis Phenol A.

24. An additive for a lubricating oil composition as described in claim 17, wherein the aldehyde is formaldehyde.

25. An additive for a lubricating oil composition as described in claim 17, the process further comprising the step of reacting the Mannich phenol coupled succinimide with a mineral acid.

26. An additive for a lubricating oil composition as described in claim 25, wherein the mineral acid is boric acid.

27. An additive for a lubricating oil composition as described in claim 17, the process further comprising the step of reacting the Mannich phenol coupled succinimide with a carboxylic acid.

28. An additive for a lubricating oil composition as described in claim 27, wherein the carboxylic acid is citric acid.

29. An additive for a lubricating oil composition as described in claim 17, the process further comprising the step of reacting the Mannich phenol coupled succinimide with at least one reactant selected from the group consisting of diacids and diesters.

30. An additive for a lubricating oil composition as described in claim 29, wherein the diester is dimethyl adipate.

31. An additive for a lubricating oil composition as described in claim 17, the process further comprising the step of reacting the Mannich phenol coupled succinimide with an anhydride.

32. An additive for a lubricating oil composition as described in claim 31, wherein the anhydride is maleic anhydride.

33. A method of making a lubricating oil dispersant, the method comprising the steps of:

reacting a polyamine with a hydrocarbyl-substituted succinic acylating agent to form a succinimide;

adding an excess of an aldehyde to the succinimide to form an iminium salt of the succinimide:

adding a polyphenolic compound selected from the group consisting of Bis Phenol A; 2,2' biphenol; 4,4' biphenol; 1,6 dihydroxynaphthalene; 2,6 dihydroxynaphthalene; 2,7 dihydroxynaphthalene; and a C12 alkyl phenol formaldehyde resin to the iminium salt to form a Mannich phenol coupled succinimide that exhibits properties attributed to cross-linking.

34. A method of making a lubricating oil dispersant as described in claim 33, wherein the process steps of adding an aldehyde and adding a polyphenolic compound are a single step.

35. A method of making a lubricating oil dispersant as described in claim 33, wherein the ratio of molecular equivalents of polyphenolic compound to aldehyde is from about 1:5 to 1:1.

36. A method of making a lubricating oil dispersant as described in claim 35, wherein the ratio of molecular equivalents of polyphenolic compound to aldehyde is from about 1:3 to 1:2.

37. A method of making a lubricating oil dispersant as described in claim 33, wherein the ratio of molecular equivalents of polyphenolic compound to succinimide is from about 10:1 to 1:5.

38. A method of making a lubricating oil dispersant as described in claim 33, wherein the ratio of molecular equivalents of polyphenolic compound to succinimide is from about 1:1 to 1:3.

39. A method of making a lubricating oil dispersant as described in claim 33, wherein the polyphenolic compound is Bis Phenol A.

40. A method of making a lubricating oil dispersant as described in claim 33, wherein the aldehyde is formaldehyde.

41. A method of making a lubricating oil dispersant as described in claim 33, the process further comprising the step of reacting the Mannich phenol coupled succinimide with a mineral acid.

42. A method of making a lubricating oil dispersant as described in claim 41, wherein the mineral acid is boric acid.

43. A method of making a lubricating oil dispersant as described in claim 33, the process further comprising the step of reacting the Mannich phenol coupled succinimide with a carboxylic acid.

44. A method of making a lubricating oil dispersant as described in claim 43, wherein the carboxylic acid is citric acid.

45. A method of making a lubricating oil dispersant as described in claim 33, the process further comprising the step of reacting the Mannich phenol coupled succinimide with at least one reactant selected from the group consisting of diacids and diesters.

46. A method of making a lubricating oil dispersant as described in claim 45, wherein the diester is dimethyl adipate.

47. A method of making a lubricating oil dispersant as described in claim 33, the process further comprising the step of reacting the Mannich phenol coupled succinimide with an anhydride.

48. A method of making a lubricating oil dispersant as described in claim 47, wherein the anhydride is maleic anhydride.

49. An engine adapted to be lubricated with a lubricating oil, the engine comprising a lubricating oil composition, the lubricating oil composition comprising a major amount of a lubrication oil and a minor dispersant amount of a reaction product prepared by the process which comprises the steps of:

reacting a polyamine with a hydrocarbyl-substituted succinic acylating agent to form a succinimide;

adding an excess of an aldehyde to the succinimide to form an iminium salt of the succinimide:

adding a polyphenolic compound selected from the group consisting of Bis Phenol A; 2,2' biphenol; 4,4' biphenol; 1,6 dihydroxynaphthalene; 2,6 dihydroxynaphthalene; 2,7 dihydroxynaphthalene; and a C12 alkyl phenol formaldehyde resin to the iminium salt to form a Mannich phenol coupled succinimide that exhibits properties attributed to cross-linking.

* * * * *